US010415842B2

(12) United States Patent
Nagahashi et al.

(10) Patent No.: US 10,415,842 B2
(45) Date of Patent: Sep. 17, 2019

(54) OUTDOOR UNIT FOR AIR CONDITIONER, AIR CONDITIONER, AND METHOD FOR CONTROLLING AIR CONDITIONER

(71) Applicant: Hitachi-Johnson Controls Air Conditioning, Inc., Tokyo (JP)

(72) Inventors: Katsuaki Nagahashi, Tokyo (JP); Koji Naito, Tokyo (JP); Hayato Mori, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 0 days.

(21) Appl. No.: 15/768,667

(22) PCT Filed: Nov. 8, 2017

(86) PCT No.: PCT/JP2017/040255

§ 371 (c)(1),
(2) Date: Apr. 16, 2018

(87) PCT Pub. No.: WO2018/142711

PCT Pub. Date: Aug. 9, 2018

(65) Prior Publication Data

US 2019/0063773 A1 Feb. 28, 2019

(30) Foreign Application Priority Data

Feb. 6, 2017 (JP) ..... 2017-019523

(51) Int. Cl.
*F25B 47/02* (2006.01)
*F24F 11/38* (2018.01)
(Continued)

(52) U.S. Cl.
CPC ..... *F24F 11/32* (2018.01); *F24F 1/06* (2013.01); *F24F 11/38* (2018.01); *F24F 11/42* (2018.01);
(Continued)

(58) Field of Classification Search
CPC .. F24F 11/32; F24F 11/38; F24F 11/41; F24F 11/42; F24F 11/74; F24F 11/75;
(Continued)

(56) References Cited

U.S. PATENT DOCUMENTS 7,407,002 B2 * 8/2008 Jang ..... F25B 13/00 165/231
2012/0291460 A1 * 11/2012 Aoyagi ..... F25B 47/025 62/79
2015/0330861 A1 * 11/2015 Alsaleem ..... G01M 3/025 702/183

FOREIGN PATENT DOCUMENTS

CN 101660808 A 3/2010
CN 104807132 A 7/2015
(Continued)

OTHER PUBLICATIONS

International Search Report and Written Opinion of PCT/JP2017/040255 dated Jan. 23, 2018.
(Continued)

*Primary Examiner* — Edward F Landrum
*Assistant Examiner* — Daniel C Comings
(74) *Attorney, Agent, or Firm* — Mattingly & Malur, PC

(57) ABSTRACT

Provided is an outdoor unit for an air conditioner and the like that provide notification of whether maintenance is needed for an outdoor heat exchange unit in appropriate timing. The outdoor unit for the air conditioner includes: a compressor; an outdoor heat exchange unit through which a refrigerant flows by driving of the compressor; an outdoor fan that includes an outdoor fan motor and is installed near the outdoor heat exchange unit; and a control unit that provides notification of whether maintenance is needed for the outdoor heat exchange unit based on an airflow resistance during an outdoor air-sending operation in which the outdoor fan is driven to send outdoor air into the outdoor heat
(Continued)

exchange unit while the compressor is stopped. This makes it possible to provide the notification of whether the maintenance is needed for the outdoor heat exchange unit in appropriate timing.

9 Claims, 14 Drawing Sheets

(51) Int. Cl.

| | |
|---|---|
| ***F24F 11/42*** | (2018.01) |
| ***F24F 11/32*** | (2018.01) |
| ***F24F 11/52*** | (2018.01) |
| ***F24F 11/62*** | (2018.01) |
| ***F24F 11/54*** | (2018.01) |
| ***F24F 1/06*** | (2011.01) |
| *F24F 1/38* | (2011.01) |

(52) U.S. Cl.
CPC ..... *F24F 11/52* (2018.01); *F24F 11/54* (2018.01); *F24F 11/62* (2018.01); *F24F 1/38* (2013.01); *F25B 47/022* (2013.01); *F25B 2500/26* (2013.01)

(58) Field of Classification Search
CPC ..... F24F 2110/00; F24F 2110/30; F24F 2110/32; F25B 2700/172; F25B 2700/173; F25B 47/02; F25B 47/022; F25B 47/025; F25B 2347/02; F25B 2500/26; F25B 2600/01
See application file for complete search history.

(56) References Cited

FOREIGN PATENT DOCUMENTS

| | | | |
|---|---|---|---|
| CN | 104930674 | A | 9/2015 |
| CN | 106288144 | A | 1/2017 |
| EP | 3 236 165 | A1 | 10/2017 |
| JP | 05-044981 | A | 2/1993 |
| JP | 10-110996 | A | 4/1998 |
| JP | 2003-269772 | A | 9/2003 |
| JP | 2004-177063 | A | 6/2004 |
| JP | 2011-247524 | A | 12/2011 |
| WO | 2016/098726 | A1 | 6/2016 |

OTHER PUBLICATIONS

Chinese Office Action received in corresponding Chinese Application No. 201780003537.5 dated Jan. 17, 2019.

* cited by examiner

OUTDOOR UNIT FOR AIR CONDITIONER, AIR CONDITIONER, AND METHOD FOR CONTROLLING AIR CONDITIONER

TECHNICAL FIELD

The present invention relates to an outdoor unit for air conditioner, and the like.

BACKGROUND ART

As a technique for detecting clogging of a filter of an indoor unit, Patent Literature 1 discloses that "it is determined that the filter is clogged when a fan motor load falls below a certain value," for example.

CITATION LIST

Patent Literature

Patent Literature 1: JP2004-177063A

SUMMARY OF INVENTION

Technical Problem

In addition to a filter of an indoor unit, an outdoor heat exchange unit may also have clogging due to motes and dust attached thereto. When such clogging occurs in the outdoor heat exchange unit, the airflow volume of the air that exchanges heat with a refrigerant is decreased to cause decrease of the heat exchange efficiency and increase of the electricity cost.

In addition, also in a case where an obstacle (such as another device) is installed near the outdoor heat exchange unit, the airflow resistance is increased to cause decrease of the heat exchange efficiency and increase of the electricity cost.

Taking into consideration these circumstances, the technique of Patent Literature 1 may be applied for detecting clogging or the like in the outdoor heat exchange unit, for example. More specifically, when an outdoor fan motor load falls below a certain value during an air conditioning operation (a heating operation, a cooling operation, or the like), a control unit may determine that "the clogging or the like occurs in the outdoor heat exchange unit."

However, for example, change of an air conditioning load during the air conditioning operation changes the temperature of the refrigerant flowing through the outdoor heat exchange unit. In addition, the change of an air conditioning load changes the temperature of the air flowing toward the outdoor fan, and the density of the air. As a result, there is a possibility that even though the outdoor heat exchange unit is clogged at the same degree, the value of the outdoor fan motor load may vary depending on how large the air conditioning load is. That is, when the technique described in Patent Literature 1 is applied for detecting the clogging or the like in the outdoor heat exchange unit, there is a possibility that notification of whether maintenance is needed for the outdoor heat exchange unit cannot be provided in appropriate timing.

Thus, an object of the present invention is to provide an outdoor unit for an air conditioner and the like that provide notification of whether the maintenance is needed for an outdoor heat exchange unit in appropriate timing.

Solution to Problem

To solve the above problems, the present invention is characterized in that notification of whether maintenance is needed for an outdoor heat change unit is provided based on the airflow resistance during an outdoor air-sending operation in which an outdoor fan is driven to send the outdoor air into the outdoor heat exchange unit while a compressor is stopped.

Advantageous Effects of Invention

According to the present invention, an outdoor unit for an air conditioner and the like that provide notification of whether maintenance is needed for an outdoor heat exchange unit in appropriate timing can be provided.

DESCRIPTION OF EMBODIMENTS

First Embodiment

<Configuration of Air Conditioner>

Figure 1:
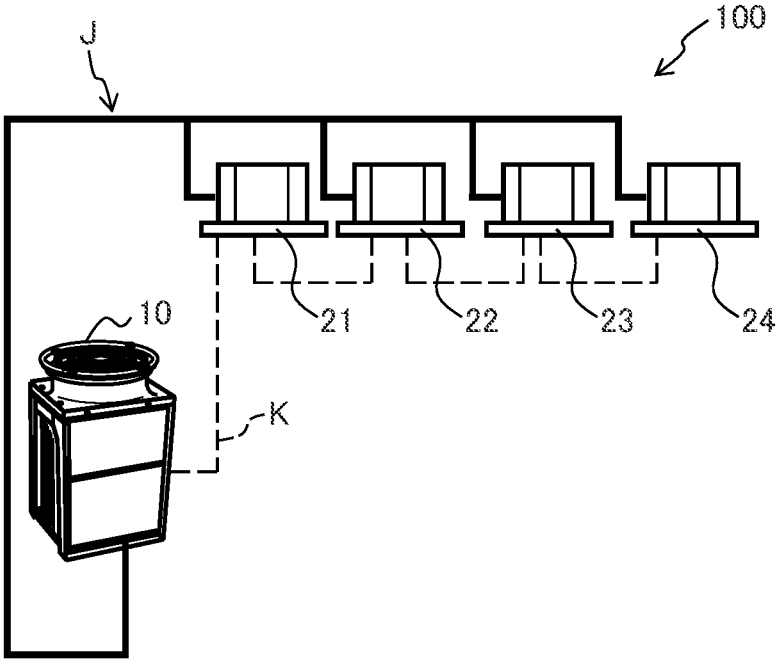
FIG. 1 is a configuration diagram of an air conditioner according to First Embodiment of the present invention.

FIG. 1 is a configuration diagram of an air conditioner 100 according to First Embodiment.

FIG. 1 shows refrigerant piping of a refrigerant circuit J with solid line while shows a communication line K with broken line.

The air conditioner 100 shown in FIG. 1 is a device for air conditioning that comprises a top-blown type outdoor unit 10 and ceiling-embedded type indoor units 21 to 24. The outdoor unit 10 is installed with a compressor 12, an outdoor heat exchange unit 15, an outdoor fan 16, and the like described later (see FIG. 3). The indoor units 21 to 24 are installed with indoor heat exchange units, indoor fans, and the like respectively (not shown).

In the example shown in FIG. 1, a refrigerant is circulated through the well-known heat pump cycle in the refrigerant circuit J made of one outdoor unit 10 and four indoor units 21 to 24 connected in parallel via the refrigerant piping.

The illustration of the refrigerant piping is simplified in FIG. 1, and refrigerant piping for introducing the refrigerant from the outdoor unit 10 to the indoor units 21 to 24 and refrigerant piping for introducing the refrigerant from the indoor units 21 to 24 to the outdoor unit 10 are shown with common solid line. In addition, the outdoor unit 10 and the indoor unit 21 are communicable with each other via the communication line K (similar to the outdoor unit 10 and each of the other indoor units 22 to 24).

Figure 2:
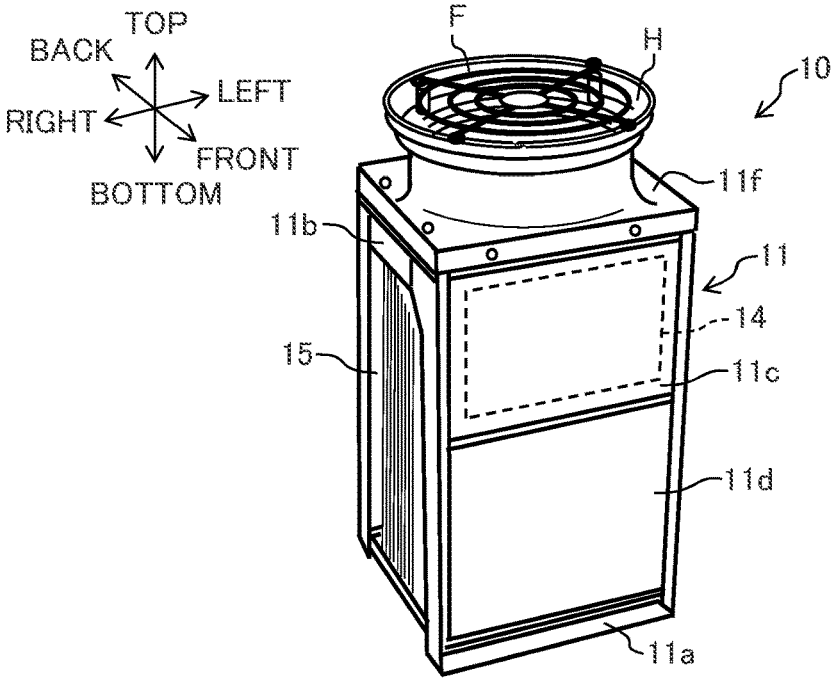
FIG. 2 is a perspective view of an outdoor unit provided in the air conditioner according to First Embodiment of the present invention.

FIG. 2 is a perspective view of the outdoor unit 10 provided in the air conditioner 100.

Front and back, right and left, and top and down are defined assuming that a side of the outdoor unit 10 provided with a later-described electrical component box 14 (the drawing surface side in FIG. 2) is the front side. As shown in FIG. 2, the outdoor unit 10 comprises a casing 11 with an outlet H provided on the top part thereof. Other configurations shown in FIG. 2 are subsequently described using FIG. 3.

Figure 3:
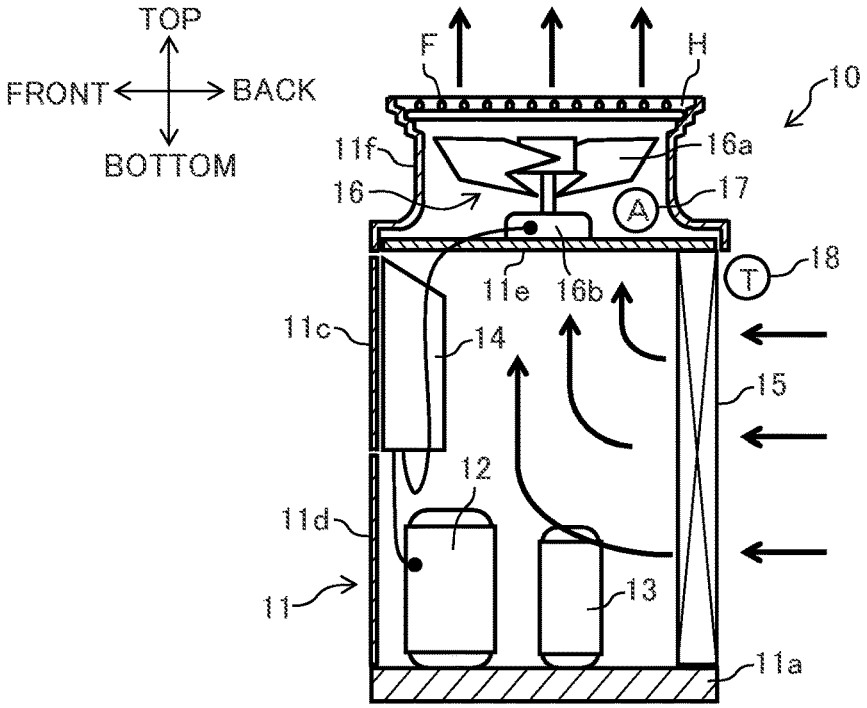
FIG. 3 is a longitudinal cross-sectional view of the outdoor unit provided in the air conditioner according to First Embodiment of the present invention.

FIG. 3 is a longitudinal cross-sectional view of the outdoor unit 10 provided in the air conditioner 100.

Figure 4:
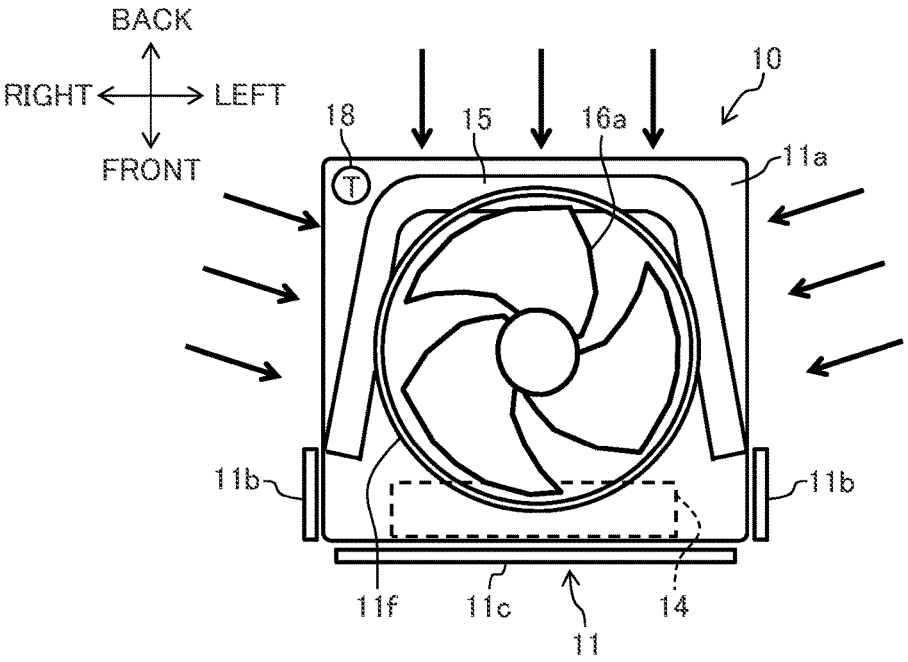
FIG. 4 is a plan view of the outdoor unit provided in the air conditioner according to First Embodiment of the present invention.

Arrows shown in FIG. 3 show airflows (similar to FIG. 4). In FIG. 3, illustration of wirings connected to a current detector 17 and an outdoor air temperature sensor 18 are omitted, and illustration of the refrigerant piping is also omitted.

As shown in FIG. 3, the outdoor unit 10 comprises the casing 11, the compressor 12, an accumulator 13, the electrical component box 14, the outdoor heat exchange unit 15, the outdoor fan 16, the current detector 17, and the outdoor air temperature sensor 18.

The casing 11 is a member installed with the compressor 12, the outdoor heat exchange unit 15, the outdoor fan 16, and the like. The casing 11 comprises not only a bottom plate 11*a*, a service covers 11*c* and 11*d*, a support plate 11*e*, and a top surface cover 11*f* shown in FIG. 3, but also two side surface covers 11*b* and 11*b* (see FIG. 4).

The bottom plate 11*a* is a plate that supports the compressor 12, the accumulator 13, the outdoor heat exchange unit 15, and the like.

The side surface covers 11*b* and 11*b* (see FIG. 4) are covers that cover a part of the right surface and a part of the left surface of the outdoor unit 10 respectively.

The service covers 11*c* and 11*d* are covers installed on the front surface of the outdoor unit 10 that are detachable during maintenance and the like of the outdoor unit 10. The electrical component box 14 is exposed by detaching the upper service cover 11*c*, and the compressor 12 and the like are exposed by detaching the lower service cover 11*d*.

The compressor 12 is a device that compresses a gas refrigerant at low temperature and low pressure and discharges that refrigerant as a gas refrigerant at high temperature and high pressure. An "air conditioning operation" is performed by driving this compressor 12 and circulating the refrigerant through the well-known heat pump circuit in the refrigerant circuit J (see FIG. 1).

The accumulator 13 is a shell-shaped member that separates gas from the liquid in the refrigerant in an inlet side of the compressor 12.

The electrical component box 14 is a box that stores later-described main control circuit 19*a* (see FIG. 5), compressor controller 19*b*, fan controller 19*c*, and the like.

The outdoor heat exchange unit 15 is a heat exchange unit through which the refrigerant flows by driving of the compressor 12. The refrigerant flowing through a heat-transfer pipe (not shown) in this outdoor heat exchange unit 15 exchanges heat with air. In addition, the casing 11 is also installed with parts such as a four-way valve that switches a flow route of the refrigerant and an expansion valve that decompresses the refrigerant, although they are not shown in FIG. 3.

The outdoor fan 16 is a fan installed near the outdoor heat exchange unit 15 to make air flow through the outdoor heat exchange unit 15. In the example shown in FIG. 3, the outdoor fan 16 is arranged near the outlet H provided on the top part of the casing 11. The outdoor fan 16 comprises a fan main body 16*a* (also called a propeller fan) and an outdoor fan motor 16*b* that rotates this fan main body 16*a*.

The support plate 11*e* shown in FIG. 3 is a rectangular plate arranged near a lower edge of the top surface cover 11*f* to support the outdoor fan 16.

The top surface cover 11*f* is a tube-shaped cover arranged in a way to surround the outdoor fan 16. The top part of this top surface cover 11*f* is installed with a net F for protection.

The current detector 17 detects current flowing through the outdoor fan motor 16*b*. A shunt resistor can be used as such a current detector 17, for example; however, it is not limited thereto. The current detector 17 is shown outside the outdoor fan motor 16*b* in FIG. 3; however, the current detector 17 is actually provided in the fan controller 19*c* (see FIG. 5) that drives the outdoor fan motor 16*b*.

The outdoor air temperature sensor 18 is a sensor installed on a predetermined part of the outdoor unit 10 to detect the temperature of outdoor air.

In addition, although they are not shown in FIG. 3, the air conditioner 100 comprises multiple pressure sensors and multiple temperature sensors installed on predetermined parts of the refrigerant circuit J (see FIG. 1).

FIG. 4 is a plan view of the outdoor unit 10 provided in the air conditioner 100.

In FIG. 4, as for the top surface cover 11*f* (see FIG. 3), only an upper end surface thereof is shown and illustration of other parts is omitted.

As shown in FIG. 4, the outdoor heat exchange unit 15 is curved in a U-shape in a planar view. This outdoor heat exchange unit 15 is arranged on the back surface, a part of the right surface, and a part of the left surface of the casing 11. The rest of the right surface and the left surface (parts where the outdoor heat exchange unit 15 is not exposed in a side view) are installed with the above-described side surface covers 11*b* and 11*b* respectively.

Once the outdoor fan 16 is driven, air is taken into the casing 11 through the outdoor heat exchange unit 15, and the heat exchange is performed between this air and the refrigerant flowing through the heat-transfer pipe (not shown) in the outdoor heat exchange unit 15. The air taken into the casing 11 is discharged to the outside through the outlet H (see FIG. 3).

Figure 5:
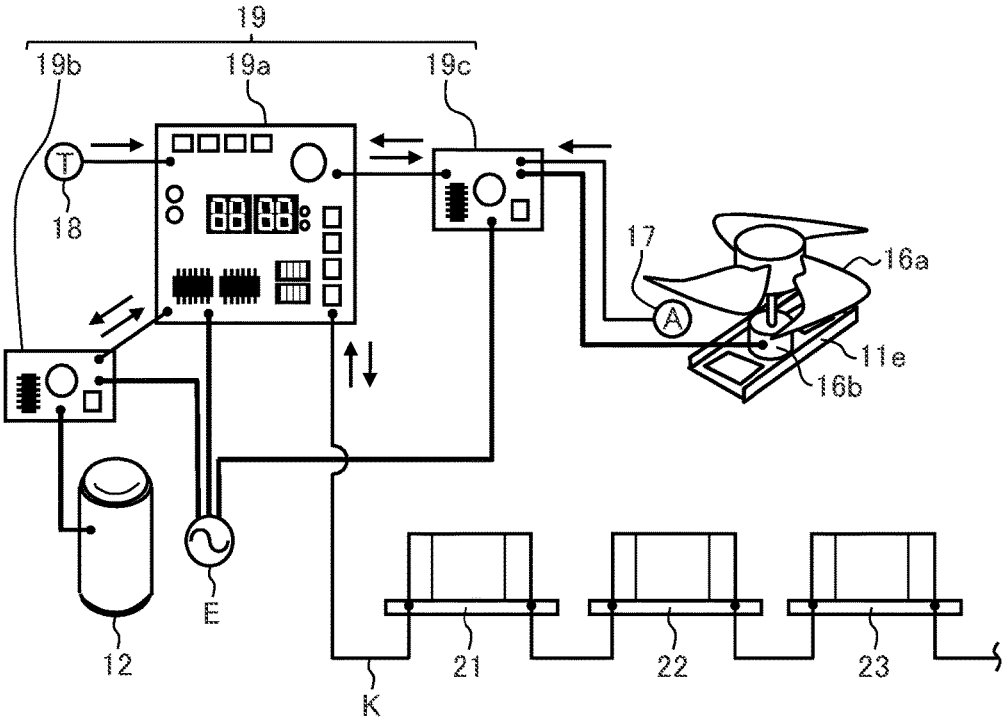
FIG. 5 is a configuration diagram related to a control system of the air conditioner according to First Embodiment of the present invention.

FIG. 5 is a configuration diagram related to a control system of the air conditioner 100.

The air conditioner 100 comprises not only the above-described configuration, but also the main control circuit 19*a*, the compressor controller 19*b*, and the fan controller 19*c*. The main control circuit 19*a*, the compressor controller 19*b*, and the fan controller 19*c* are supplied with electric power from a commercial power source E.

Each of the main control circuit 19*a*, the compressor controller 19*b*, and the fan controller 19*c* is made of electronic circuits including a central processing unit (CPU), a read only memory (ROM), a random access memory (RAM), and various interfaces (not shown). A program stored in the ROM is read and expanded in the RAM, and then the CPU executes various processing.

The main control circuit 19*a* calculates not only detected values of sensors including the outdoor air temperature sensor 18 and a pressure sensor (not shown), but also a predetermined instruction value based on a signal generated by manipulating a remote controller (not shown). The above-described instruction value includes not only rotational speed instruction values of a motor (not shown) for the compressor 12, the outdoor fan motor 16*b*, and an indoor fan motor (not shown), but also an open degree instruction value for the expansion valve (not shown) and a switch instruction for the four-way valve (not shown).

The compressor controller 19*b* controls the motor (not shown) of the compressor 12 based on the instruction value inputted from the main control circuit 19*a*.

The fan controller 19*c* controls the outdoor fan motor 16*b* based on the instruction value inputted from the main control circuit 19*a*.

Hereinafter, the electronic circuit including the main control circuit 19*a*, the compressor controller 19*b*, and the fan controller 19*c* is called a "control unit 19."

<Maintenance of Outdoor Heat Exchange Unit 15>

As a period of use of the outdoor unit 10 shown in FIG. 3 becomes longer, motes and dust are attached to a fin (not shown) of the outdoor heat exchange unit 15, and the clogging may occur in the outdoor heat exchange unit 15 in some cases. When the clogging occurs in the outdoor heat exchange unit 15 like this, the airflow volume is decreased due to increase of the airflow resistance although the outdoor fan motor 16*b* is driven in the same rotational speed, and this causes decrease of the heat exchange efficiency of the outdoor heat exchange unit 15. In addition, this increase of the airflow resistance makes the refrigeration cycle performance decrease, thereby causing increase of the electricity cost of the air conditioning operation.

Also when some obstacle is put near the outdoor heat exchange unit 15, this obstacle may make the airflow resistance of the outdoor unit 10 increase, thereby causing decrease of the heat exchange efficiency and increase of the electricity cost in some cases.

Heretofore, whether the clogging occurs in the outdoor heat exchange unit 15 has been determined during the air conditioning operation (during the cycle operation) based on a current value of the outdoor fan motor 16*b* reflecting the airflow resistance. That is, the above-described determination has been made while the refrigerant is circulating in the refrigerant circuit J (see FIG. 1) by driving of the compressor 12.

However, as the air conditioner load is changed during the air conditioning operation, the temperature of the refrigerant flowing through the outdoor heat exchange unit 15 is changed. This leads also the temperature of the air flowing toward the outdoor fan 16 to be changed and accordingly the density of the air is changed. As a result, there has been a fact that although the degree of the clogging in the outdoor heat exchange unit 15 is the same, the current values of the outdoor fan motor 16*b* may be changed depending on the degree of the air conditioner load.

That is, in the conventional techniques, timing for notifying a user and the like of that the maintenance should be given to the outdoor heat exchange unit 15 has been too early or too late in some cases. Thus, the present embodiment provides an "outdoor air-sending operation," in which the outdoor fan 16 is driven while the compressor 12 is stopped. During this "outdoor air-sending operation," the control unit 19 determines whether the maintenance is needed for the outdoor heat exchange unit 15 based on the current value of the outdoor fan motor 16*b*.

Since the refrigerant does not circulate in the refrigerant circuit J during the "outdoor air-sending operation," almost no heat exchange occurs between the air and the refrigerant in the outdoor heat exchange unit 15. That is, the temperature and the density of the air flowing through the casing 11 by driving the outdoor fan 16 are not affected that much by the above-described heat exchange. This allows the control unit 19 to make appropriate determination on whether the maintenance is needed for the outdoor heat exchange unit 15 based on the current value of the outdoor fan motor 16*b* reflecting the airflow resistance. This is one of the main characteristics of the present embodiment.

<Processing by Control Unit>

Figure 6:
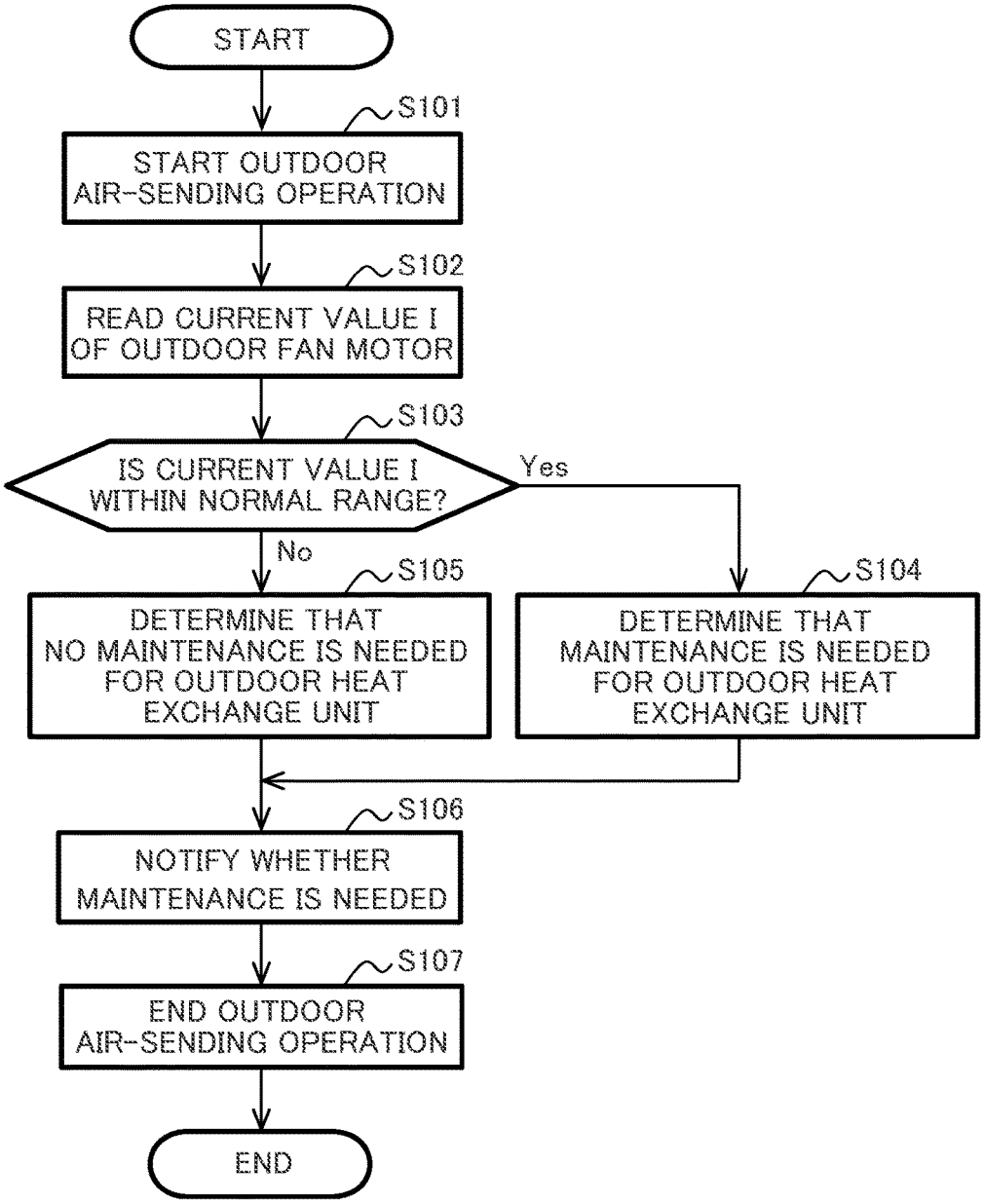
FIG. 6 is a flowchart of processing executed by a control unit of the air conditioner according to First Embodiment of the present invention.

FIG. 6 is a flowchart of processing executed by the control unit 19 of the air conditioner 100 (see FIG. 5 if necessary).

It is assumed that the air conditioning operation (a cooling operation, a heating operation, and the like) is not performed at "START" in FIG. 6. That is, it is assumed that the compressor 12 is stopping and the refrigerant is not circulating in the refrigerant circuit J at "START" in FIG. 6.

In step S101, the control unit 19 starts the outdoor air-sending operation. As described above, the "outdoor air-sending operation" is an operation mode for driving the outdoor fan 16 to send the outdoor air to the outdoor heat exchange unit 15 while stopping the compressor 12.

The "outdoor air-sending operation" can be executed at any time point included in the period in which no air conditioning operation is performed. During this outdoor air-sending operation, the indoor fan (not shown) may be stopped, or the indoor fan may be driven in accordance with manipulation of the remote controller (not shown) by the user. Driving the indoor fan in this way stirs the air inside (an air-conditioned space).

Next, in step S102 of FIG. 6, the control unit 19 reads a current value I of the outdoor fan motor 16*b* detected by the current detector 17. That is, in the present embodiment, the current value I of the outdoor fan motor 16*b* is used as a value reflecting the airflow resistance (the degree of the clogging) of the outdoor heat exchange unit 15.

In step S103, the control unit 19 determines whether the current value I read in step S102 is within a predetermined normal range. This "normal range" is a range set in advance as a criterion for determining whether the maintenance is needed for the outdoor heat exchange unit 15.

In the outdoor fan 16 having a predetermined feature, if the airflow volume is fixed, the current value I is increased as the airflow resistance of the outdoor heat exchange unit 15 is increased; however, in most cases an actual product is controlled by the number of rotation (the rotational speed). Thus, for example, if the number of rotation is fixed, the current value I may either be increased or decreased. That is, depending on the feature of the outdoor fan 16, the current value I may be decreased as the airflow resistance of the outdoor heat exchange unit 15 is increased, or the current value I may once be increased and then decreased. Taking into consideration such a feature of the outdoor fan 16, the above-described "normal range" is set in advance.

When the current value I is within the normal range in step S103 (S103: Yes), the processing by the control unit 19 proceeds to step S104.

In step S104, the control unit 19 determines that no maintenance is needed for the outdoor heat exchange unit 15 at this moment. This "maintenance" includes not only cleaning the outdoor heat exchange unit 15, but also displacing the obstacle (another device and the like) installed near the outdoor heat exchange unit 15.

On the other hand, when the current value I is out of the normal range in step S103 (S103: No), the processing by the control unit 19 proceeds to step S105.

In step S105, the control unit 19 determines that the maintenance for the outdoor heat exchange unit 15 is needed.

After the processing in step S104 or S105 is performed, the processing by the control unit 19 proceeds to step S106.

In step S106, the control unit 19 provides notification of whether the maintenance is needed. For example, the control unit 19 displays on the remote controller (not shown) whether the maintenance is needed. Or, for example, the control unit 19 transmits data providing the notification of whether the maintenance is needed to a server (not shown) that remotely monitors the state of the air conditioner 100. Then, when it is determined that the maintenance is needed for the outdoor unit 10, an email for urging the user to have the maintenance may be transmitted to a terminal (a personal computer, a smartphone, a tablet, and the like) of the user that receives the data from the server. In addition, the notification that the maintenance is needed may be displayed on displayers (not shown) of the indoor units 21 to 24.

Next, in step S107, the control unit 19 ends the air-sending operation. The series of processing shown in FIG. 6 may be performed regularly (once a day, once a week, and the like) or may be performed irregularly (e.g., according to timing of start or end of the air conditioning operation).

Figure 7:
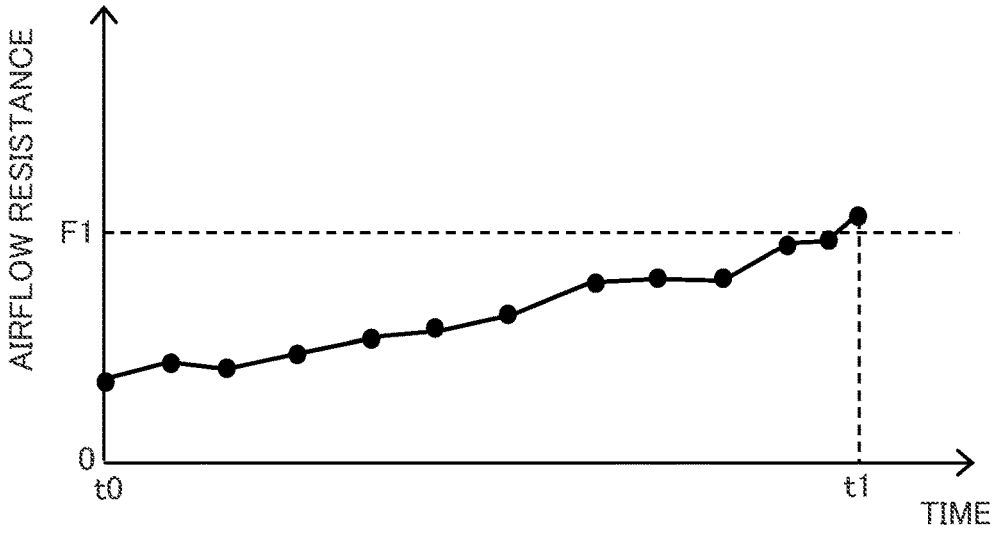
FIG. 7 is an explanatory diagram that shows changes in the airflow resistance of an outdoor heat exchange unit provided in the air conditioner according to First Embodiment of the present invention.

FIG. 7 is an explanatory diagram that shows changes in the airflow resistance of the outdoor heat exchange unit 15.

The horizontal axis of FIG. 7 is time while the vertical axis thereof is the airflow resistance of the outdoor heat exchange unit 15. Each of the multiple points plotted on the explanatory diagram in FIG. 7 indicates that the outdoor air-sending operation (S101 in FIG. 6) is performed (similar to FIG. 8).

A threshold value F1 shown in FIG. 7 is a threshold value set in advance as a criterion for determining whether the maintenance is needed for the outdoor heat exchange unit 15. Corresponding to a range equal to or smaller than this threshold value F1, the "normal range" of the current value I of the outdoor fan motor 16*b* (S103 in FIG. 6) is set in advance.

As shown in FIG. 7, the airflow resistance of the outdoor heat exchange unit 15 is gradually increased as time passes. This is because motes and dusts are attached to the fin (not shown) of the outdoor heat exchange unit 15. In the outdoor air-sending operation at time t1 in FIG. 7, the airflow resistance exceeds the threshold value F1. As a result, the current value I of the outdoor fan motor 16*b* falls outside the predetermined normal range (S103 of FIG. 6: No). Thus, the notification that "the maintenance is needed for the outdoor heat exchange unit 15" is provided in appropriate timing (S105, S106).

Figure 8:
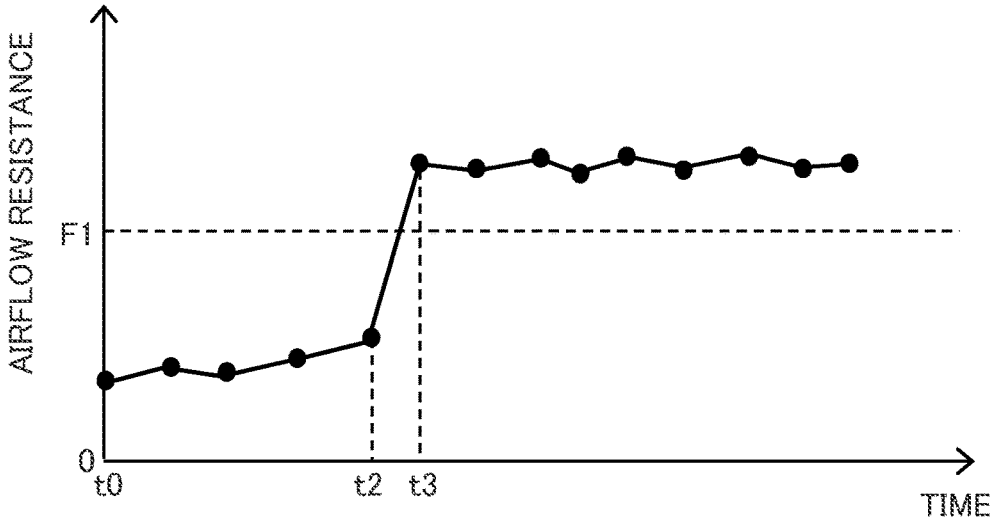
FIG. 8 is an explanatory diagram that shows another example related to the changes in the airflow resistance of the outdoor heat exchange unit provided in the air conditioner according to First Embodiment of the present invention.

FIG. 8 is an explanatory diagram that shows another example related to the changes in the airflow resistance of the outdoor heat exchange unit 15.

It is assumed that the obstacle (e.g., another device: not shown) is put near the outdoor heat exchange unit 15 at time t2 shown in FIG. 8. During the outdoor air-sending operation (time t3) immediately after the obstacle is put, the airflow resistance of the outdoor unit 10 is rapidly increased due to the effect of this obstacle. As a result, the current value I of the outdoor fan motor 16*b* falls outside the normal range (S103 in FIG. 6: No), and thus it is determined that "the maintenance is needed for the outdoor heat exchange unit 15" (S105). As described above, the "maintenance" includes the processing for displacing the obstacle near the outdoor heat exchange unit 15.

Based on the airflow resistance (the current value I) during outdoor air-sending operation in last time and the airflow resistance (the current value I) during the current outdoor air-sending operation, the temporal change rate of the airflow resistance may be calculated. Then, when this change rate is smaller than a predetermined threshold value, the control unit 19 may determine that "the clogging occurs" in the outdoor heat exchange unit 15 (see FIG. 7), and when the change rate is equal to or greater than the predetermined threshold value, the control unit 19 may determine that "the obstacle is put" near the outdoor heat exchange unit 15 (see FIG. 8). In this way, more detailed information on the maintenance can be presented to the user.

<Effect>

According to First Embodiment, based on the airflow resistance during the outdoor air-sending operation in which the outdoor fan 16 is driven while the compressor 12 is stopped (that is, based on the current value I), the control unit 19 determines whether the maintenance is needed for the outdoor heat exchange unit 15. In this way, as described the above, the notification of whether the maintenance is needed for the outdoor heat exchange unit 15 can be provided in appropriate timing.

Second Embodiment

Second Embodiment is different from First Embodiment in that whether the maintenance is needed is determined based on the ratio I/I0, which is the ratio of the current value I during the current outdoor air-sending operation to a current value I0 during the outdoor air-sending operation under the condition where the outdoor heat exchange unit 15 is confirmed as normally operating. Other configurations (e.g., the configuration of the air conditioner 100: see FIGS. 1 to 5) are similar to that of First Embodiment. Thus, the part different from First Embodiment is described but descriptions of the duplicated parts are omitted.

Figure 9:
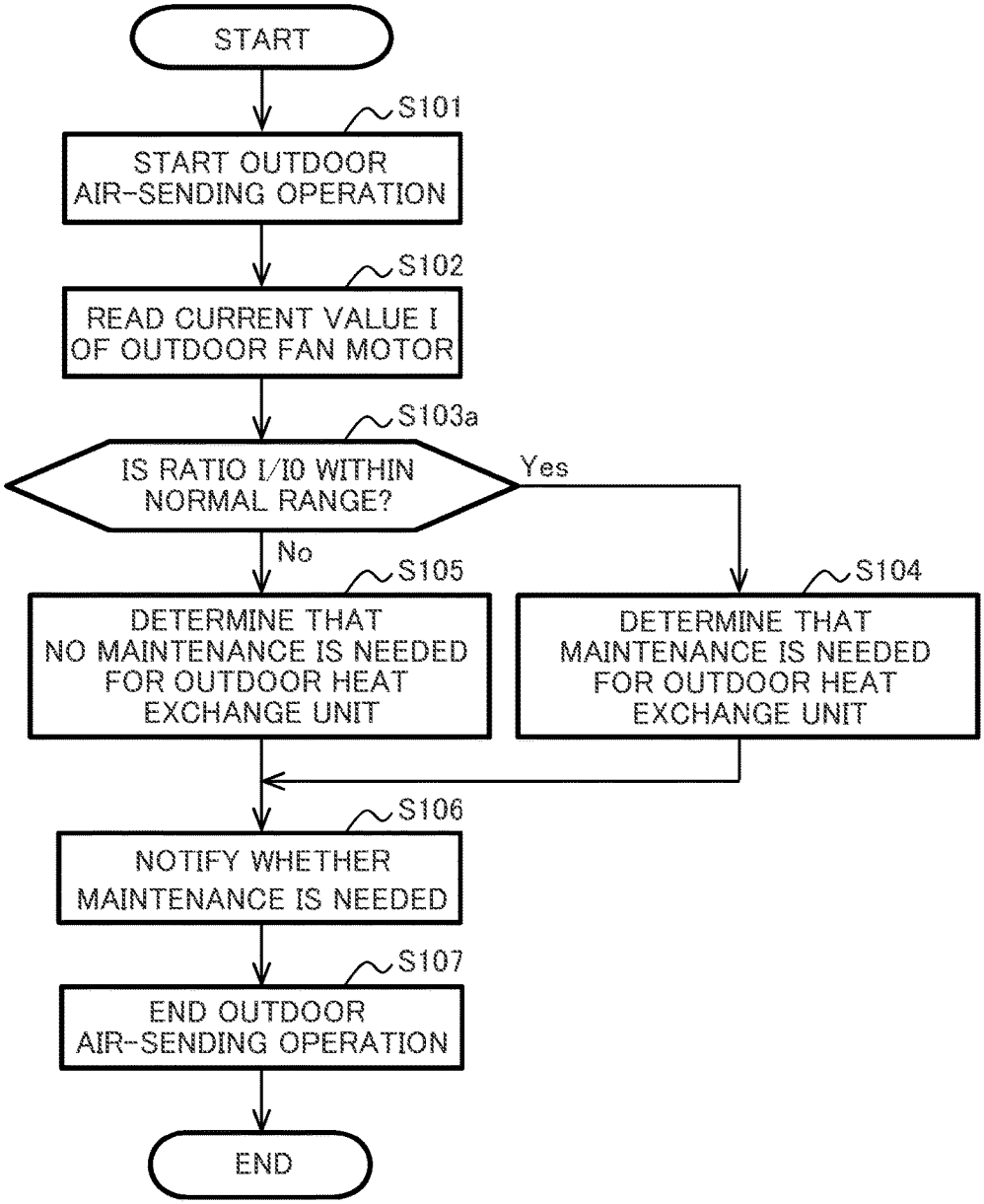
FIG. 9 is a flowchart of processing executed by a control unit of an air conditioner according to Second Embodiment of the present invention.

FIG. 9 is a flowchart of processing executed by the control unit 19 of the air conditioner 100 according to Second Embodiment (see FIG. 5 if necessary).

In FIG. 9, the processing similar to that in First Embodiment (see FIG. 6) is denoted by the same step number. In addition, a current value of the outdoor fan motor 16*b* during the outdoor air-sending operation under the condition where the outdoor heat exchange unit 15 is confirmed as normally operating (that is, no clogging or the like is found) is referred to as the "current value I0."

After reading the current value I of the outdoor fan motor 16*b* in step S102, the control unit 19 determines whether the ratio I/I0 is within the normal range in step S103*a*. This ratio I/I0 is a ratio of the current value I during the current outdoor air-sending operation to the above-described current value I0.

When the ratio I/I0 is within the normal range in step S103*a* (S103*a*: Yes), the processing by the control unit 19 proceeds to step S104.

On the other hand, when the ratio I/I0 is out of the normal range in step S103*a* (S103*a*: No), the processing by the control unit 19 proceeds to step S105.

Since the processing in steps S104 to S107 is similar to that in First Embodiment, the description thereof is omitted.

<Effect>

According to Second Embodiment, based on the ratio I/I0, the "normal range" as the criterion for determining whether the maintenance is needed can be set uniformly for various models of air conditioners. Especially in recent years, not only the casing 11 and the outdoor heat exchange unit 15 but also the outdoor fan 16 is produced in a wide variety of types. For instance, the "normal range" has to be set individually to each model of the air conditioner when First Embodiment is applied, while the "normal range" can be set uniformly even when the models are varied when Second Embodiment is applied. This is because the "normal range" related to the ratio I/I0 has not that much difference even when the models of the air conditioner are varied. Thus, according to Second Embodiment, a worker can save the effort of setting the "normal range" in a designing phase of the air conditioner 100.

Some user has to allow a situation where the obstacle is present near the outdoor heat exchange unit 15 because of an installation space, for example. In addition, when a duct (not shown) is installed on an inlet side of the outdoor heat exchange unit 15, the airflow resistance is likely to become greater than usual. In such a case, the control unit 19 stores the current value during the state where the obstacle is present or the state where the duct is installed as the "current value I0 during the normal state" and determines whether the maintenance is needed for the current outdoor heat exchange unit 15 based on the ratio (I/I0) of the current value I to the stored current value I0.

A trigger for storing the above-described current value I0 (the current value during the normal state where the obstacle and the like are installed) is manipulation of the remote controller by the worker, for example. Using such a ratio (I/I0) makes it possible to correspond flexibly to various situations and to make appropriate determination on whether the maintenance is needed for the outdoor heat exchange unit 15. The current value I0 under the condition where the outdoor heat exchange unit 15 is confirmed as normally operating may be updated periodically if necessary.

Third Embodiment

Third Embodiment is different from First Embodiment in that the outdoor air-sending operation is performed before the air conditioning operation; however, other configurations are similar to that of First Embodiment. Thus, the part different from First Embodiment is described but descriptions of the duplicated parts are omitted.

Figure 10:
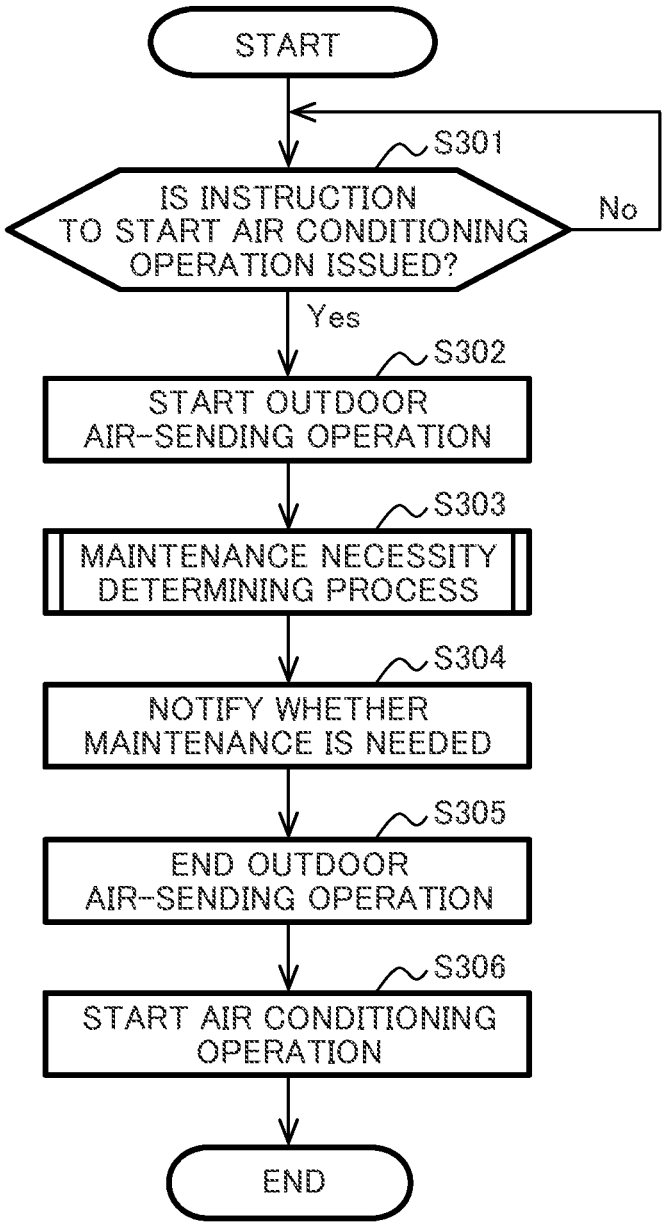
FIG. 10 is a flowchart of processing executed by a control unit of an air conditioner according to Third Embodiment of the present invention.

FIG. 10 is a flowchart of processing executed by the control unit 19 of the air conditioner 100 according to Third Embodiment (see FIG. 5 if necessary).

It is assumed that both the air conditioning operation and the outdoor air-sending operation are not performed at "START" in FIG. 10.

In step S301, the control unit 19 determines whether an instruction to start the air conditioning operation is issued using the remote controller (not shown). When the instruction to start the air conditioning operation is issued (S301: Yes), the processing by the control unit 19 proceeds to step S302. On the other hand, when no instruction to start the air conditioning operation is issued (S301: No), the control unit 19 repeats the processing in step S301.

In step S302, the control unit 19 starts the outdoor air-sending operation. That is, the control unit 19 drives the outdoor fan 16 while stopping the compressor 12.

In step S303, the control unit 19 executes maintenance necessity determining processing. This "maintenance necessity determining processing" is processing similar to that in steps S102 to S105 described in First Embodiment (see FIG. 6). In other words, when the instruction to start the air conditioning operation is received (S301: Yes), the control unit 19 performs the outdoor air-sending operation (S302) before the air conditioning operation (S306) and determines whether the maintenance is needed for the outdoor heat exchange unit 15 based on the airflow resistance (the current value I) during this outdoor air-sending operation (S303).

Next, in step S304, the control unit 19 provides the notification of whether the maintenance is needed for the outdoor heat exchange unit 15. For example, the control unit 19 displays the notification that the maintenance is needed on the remote controller (not shown).

In step S305, the control unit 19 ends the outdoor air-sending operation.

In step S306, the control unit 19 starts the air conditioning operation (the heating operation, the cooling operation, and the like).

<Effect>

According to Third Embodiment, the outdoor air-sending operation is performed (S302) before the air conditioning operation (S306), and whether the maintenance is needed for the outdoor heat exchange unit 15 is determined during this outdoor air-sending operation (S303). Thus, the determination on whether the maintenance is needed for the outdoor heat exchange unit 15 can be made without interrupting the air conditioning operation, and comfort of the air conditioning for the user can be improved more than First Embodiment.

Fourth Embodiment

Fourth Embodiment is different from Third Embodiment in that when an instruction to start the heating operation is issued, the outdoor air-sending operation is performed after a defrosting operation; however, other configurations are similar to that of Third Embodiment. Thus, the part different from Third Embodiment is described but descriptions of the duplicated parts are omitted.

Figure 11:
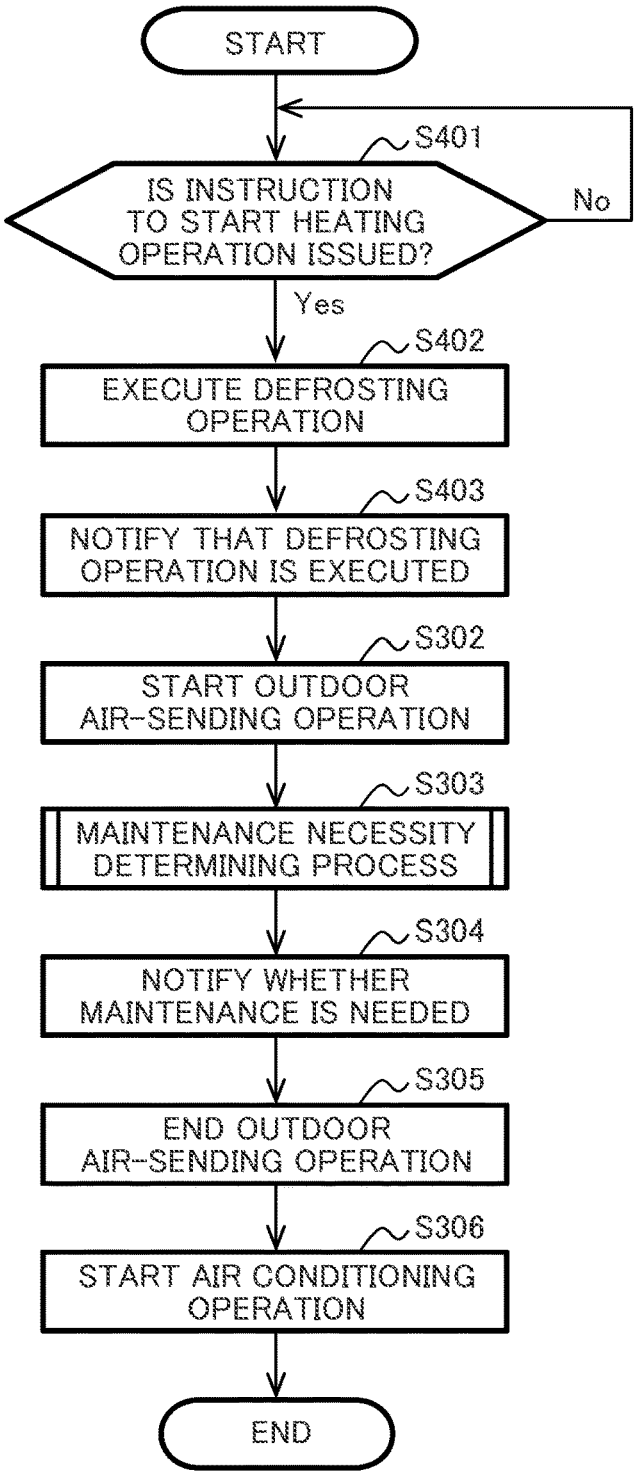
FIG. 11 is a flowchart of processing executed by a control unit of an air conditioner according to Fourth Embodiment of the present invention.

FIG. 11 is a flowchart of processing executed by the control unit 19 of the air conditioner 100 according to Fourth Embodiment (see FIG. 5 if necessary).

The processing similar to that in Third Embodiment (see FIG. 10) is denoted by the same step number.

In step S401, the control unit 19 determines whether the instruction to start the heating operation is issued using the remote controller (not shown). When the instruction to start the heating operation is issued (S401: Yes), the processing by the control unit 19 proceeds to step S402. On the other hand, when no instruction to start the heating operation (S401: No), the control unit 19 repeats the processing in step S401.

In step S402, the control unit 19 executes the defrosting operation to defrost the outdoor heat exchange unit 15. This "defrosting operation" is an operation mode for melting frost and snow attached on the outdoor heat exchange unit 15 to recover its heat exchange performance. As a specific description of the "defrosting operation," the control unit 19 stops the compressor 12 once, makes the outdoor heat exchange unit 15 functions as a condenser, switches the four-way valve (not shown) so as to make the indoor heat exchange unit (not shown) functions as an evaporator, and then drives the compressor 12 again. In this way, the high-temperature refrigerant flows through the heat-transfer pipe of the outdoor heat exchange unit 15, thereby gradually melting the frost and snow attached on the outdoor heat exchange unit 15. Note that the indoor fan (not shown) is stopped during the defrosting operation except when detecting the room temperature (temperature of the air-conditioned space).

In step S403, the control unit 19 notifies the user of that the defrosting operation is executed. For example, the controller 19 makes the above notification in several ways such as by lighting the displayer (not shown) installed in each of the indoor units 21 to 24 (see FIG. 1) and by displaying the notification of the remote controller (not shown). In this case, when the instruction to start the heating operation is received (S401: Yes), the control unit 19 executes the defrosting operation to defrost the outdoor heat exchange unit 15 (S402) before the outdoor air-sending operation (S302), and also provides the notification that this defrosting operation is executed (S403). This allows the user to understand that the defrosting operation is executed and no heating operation is performed for a while after a start button (not shown) of the heating operation is pressed.

Next, the process by the control unit 19 proceeds to step S302. Since the processing in steps S302 to S306 is similar to that in Third Embodiment (see FIG. 10), the description thereof is omitted.

<Effect>

According to Fourth Embodiment, the defrosting operation is performed (S402) before the outdoor air-sending operation (S302). For instance, when the maintenance necessity determining processing is performed (S303) while the outdoor heat exchange unit 15 is covered with snow, the airflow resistance of the outdoor heat exchange unit 15 becomes greater than usual due to the effect of the snow. However, in Fourth Embodiment, the maintenance necessity determining processing is performed (S303) after the snow attached on the outdoor heat exchange unit 15 is melted by the defrosting operation (S402); thus, appropriate determination on whether the clogging occurs in the outdoor heat exchange unit 15 (whether there is the obstacle) can be made.

Fifth Embodiment

Fifth Embodiment is different from First Embodiment in that the outdoor air-sending operation is performed when an instruction to stop the air conditioning operation is issued; however, other configurations are similar to that of First Embodiment. Thus, the part different from First Embodiment is described but descriptions of the duplicated parts are omitted.

Figure 12:
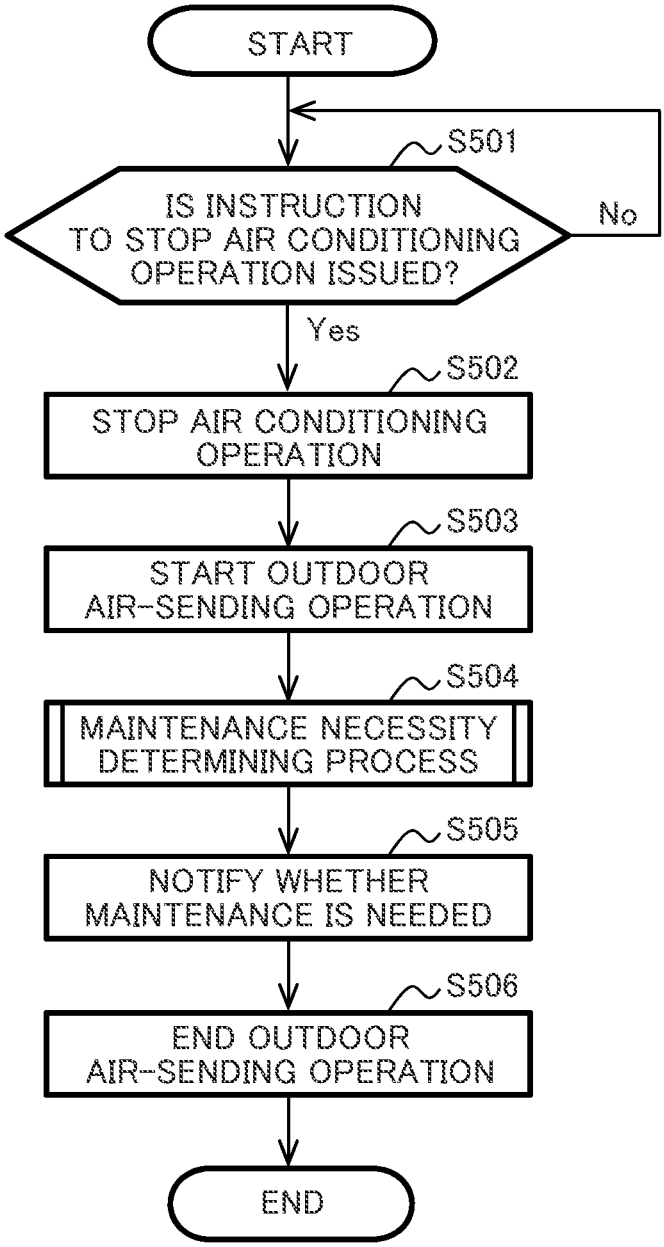
FIG. 12 is a flowchart of processing executed by a control unit of an air conditioner according to Fifth Embodiment of the present invention.

FIG. 12 is a flowchart of processing executed by the control unit 19 of the air conditioner 100 according to Fifth Embodiment (see FIG. 5 if necessary).

It is assumed that the air conditioning operation (the cooling operation, the heating operation, and the like) is performed at "START" in FIG. 12.

In step S501, the control unit 19 determines whether the instruction to stop the air conditioning operation is issued using the remote controller (not shown). When the instruction to stop the air conditioning operation is issued (S501: Yes), the processing by the control unit 19 proceeds to step S502. On the other hand, when no instruction to stop the air conditioning operation is issued (S501: No), the control unit 19 repeats the processing in step S501 and continues the air conditioning operation.

In step S502, the control unit 19 stops the air conditioning operation. That is, the control unit 19 stops at least the compressor 12.

In step S503, the control unit 19 starts the outdoor air-sending operation. In this way, the control unit 19 performs the outdoor air-sending operation after stopping the air conditioning operation (S502, S503).

In step S504, the control unit 19 executes the maintenance necessity determining processing. This maintenance necessity determining processing is processing similar to that in steps S102 to S105 described in First Embodiment (see FIG. 6). That is, the control unit 19 determines whether the maintenance is needed for the outdoor heat exchange unit 15 based on the airflow resistance (the current value I) during the outdoor air-sending operation.

Next, in step S505, the control unit 19 provides the notification of whether the maintenance is needed. For example, the control unit 19 displays the notification that the maintenance is needed on the remote controller (not shown).

In step S506, the control unit 19 ends the outdoor air-sending operation.

<Effect>

According to Fifth Embodiment, the outdoor air-sending operation is performed after the air conditioning operation is stopped (S502, S503). Thus, a time lag between use of the remote controller (not shown) to actual start of the cooling operation or the heating operation can be shorter than that in Third Embodiment in which the outdoor air-sending operation is performed before the start of the air conditioning operation (see FIG. 10). In this way, comfort of the air conditioning for the user can be improved more than Third Embodiment.

Sixth Embodiment

Sixth Embodiment is different from First Embodiment in that the determination on whether the maintenance is needed for the outdoor heat exchange unit 15 is made based on the current value I of the outdoor fan motor 16*b* and an outdoor air temperature; however, other configurations (e.g., the configuration of the air conditioner 100: see FIGS. 1 to 5) are similar to that of First Embodiment. Thus, the part different from First Embodiment is described but descriptions of the duplicated parts are omitted.

Figure 13:
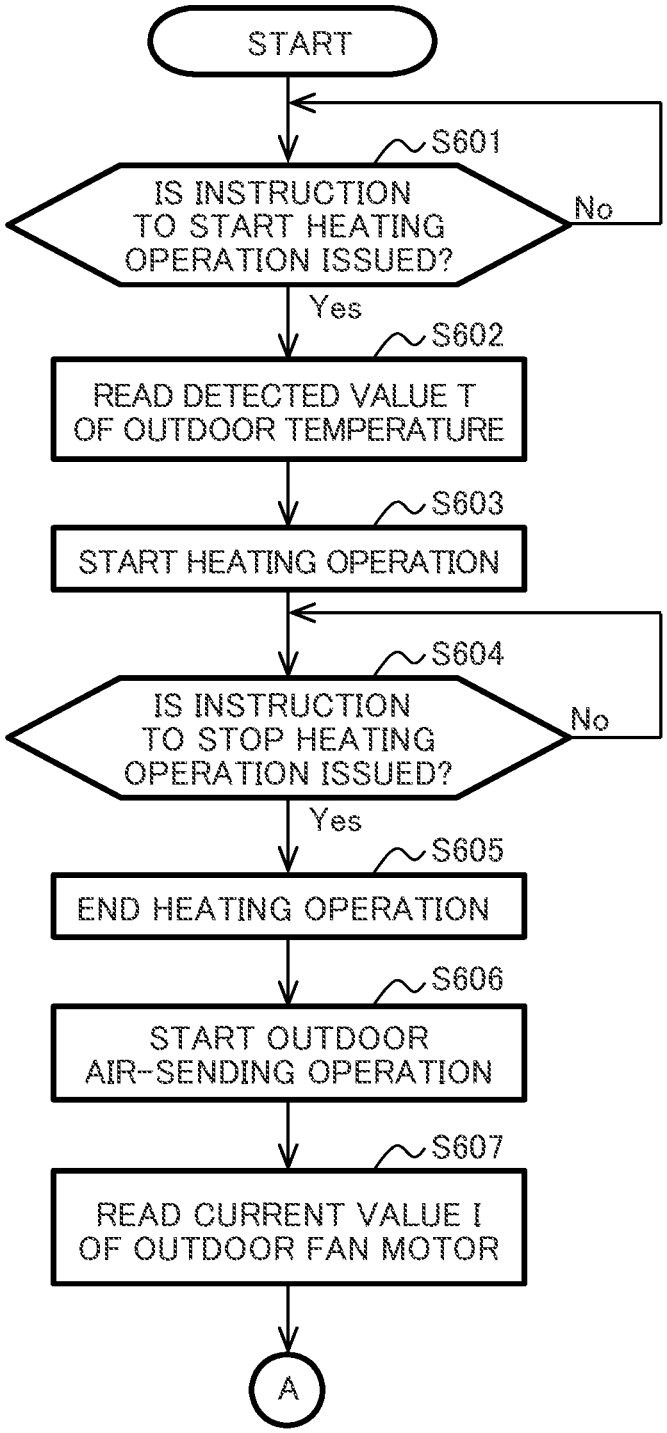
FIG. 13 is a flowchart of processing executed by a control unit of an air conditioner according to Sixth Embodiment of the present invention.
Figure 14:
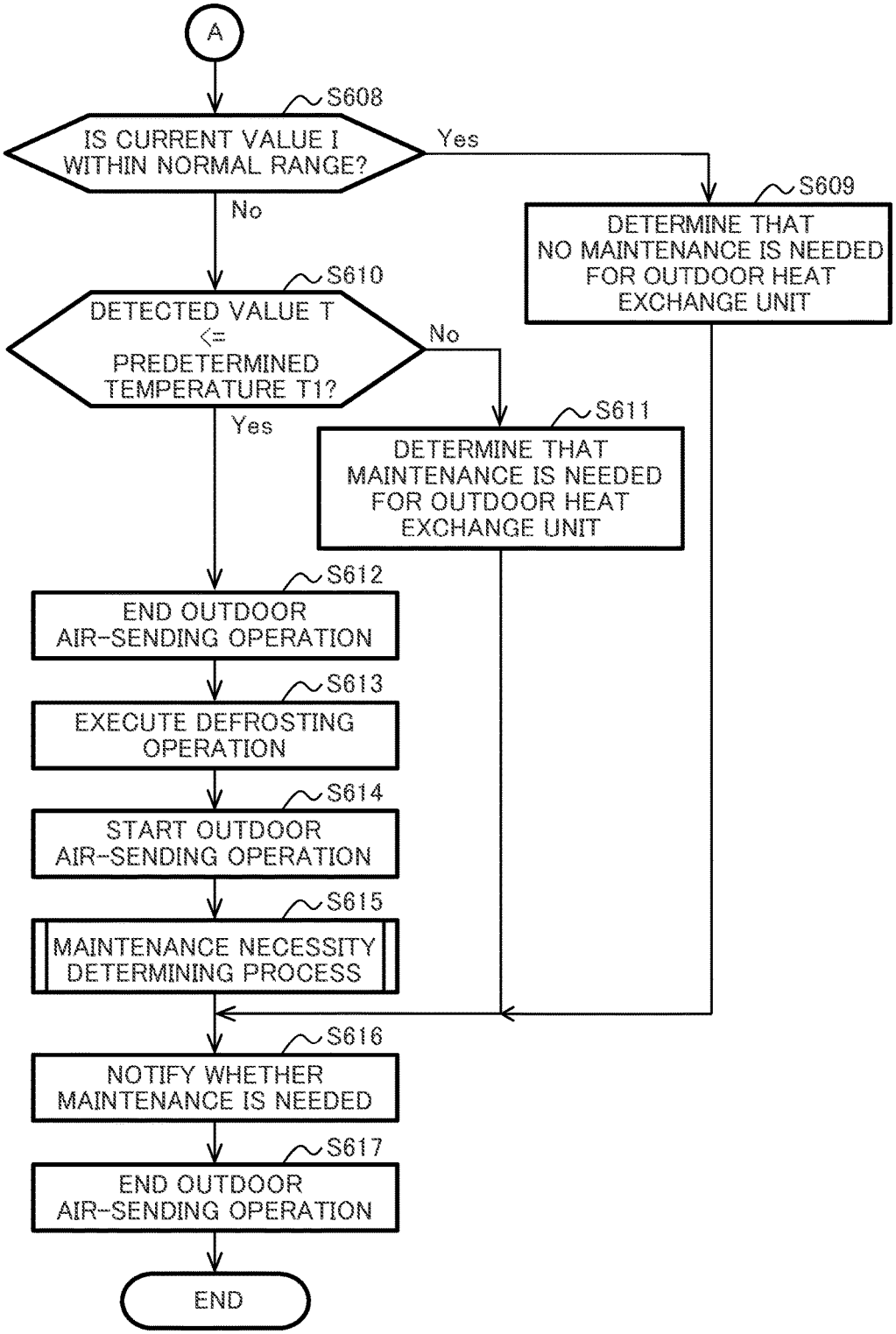
FIG. 14 is a flowchart of the processing executed by the control unit of the air conditioner according to Sixth Embodiment of the present invention.

FIGS. 13 and 14 are flowcharts of processing executed by the control unit 19 of the air conditioner 100 according to Sixth Embodiment (see FIG. 5 if necessary).

It is assumed that both the air conditioning operation and the outdoor air-sending operation are not performed at "START" in FIG. 12.

In step S601, the control unit 19 determines whether the instruction to start the heating operation is issued using the remote controller (not shown). When the instruction to start the heating operation is issued (S601: Yes), the processing by the control unit 19 proceeds to step S602. On the other hand, when no instruction to start the heating operation is issued (S601: No), the control unit 19 repeats the processing in step S601.

In step S602, the control unit 19 reads a detected value T of the outdoor air temperature obtained by the outdoor air temperature sensor 18. That is, the control unit 19 stores the outdoor air temperature of when the heating operation is started.

In step S603, the control unit 19 starts the heating operation.

In step S604, the control unit 19 determines whether an instruction to stop the heating operation is issued using the remote controller (not shown). When the instruction to stop the heating operation is issued (S604: Yes), the processing by the control unit 19 proceeds to step S605. On the other hand, when no instruction to stop the heating operation is issued (S604: No), the control unit 19 repeats the processing in step S604 and continues the heating operation.

In step S605, the control unit 19 ends the heating operation.

In step S606, the control unit 19 starts the outdoor air-sending operation. That is, the control unit 19 drives the outdoor fan 16 while stopping the compressor 12.

In step S607, the control unit 19 reads the current value I of the outdoor fan motor 16*b*.

Next, in step S608 of FIG. 14, the control unit 19 determines whether the current value I of the outdoor fan motor 16*b* is within the predetermined normal range. When the current value I of the outdoor fan motor 16*b* is within the predetermined normal range (S608: Yes), the processing by the control unit 19 proceeds to step S609.

In step S609, the control unit 19 determines that no maintenance is needed for the outdoor heat exchange unit 15 at this moment. That is, the control unit 19 determines that no cleaning and the like are needed for the outdoor heat exchange unit 15, makes the notification thereof (S616), and then ends the outdoor air-sending operation (S617).

On the other hand, in step S608, when the current value I of the outdoor fan motor 16*b* is out of the predetermined normal range (S608: No), the processing by the control unit 19 proceeds to step S610.

In step S610, the control unit 19 determines whether the detected value T of the outdoor air temperature read in step S602 is equal to or lower than a predetermined temperature T1. This predetermined temperature T1 (e.g., 0° C.) is a threshold set in advance as a criterion for determining that the determination on whether the maintenance is needed for the outdoor heat exchange unit 15 again is made or not.

When the detected value T of the outdoor air temperature is equal to or lower than the predetermined temperature T1, the outdoor heat exchange unit 15 may be covered with fallen snow in some cases.

In step S610, when the detected value T of the outdoor air temperature is higher than the predetermined temperature T1 (S610: No), the processing by the control unit 19 proceeds to step S611.

In step S611, the control unit 19 determines that the maintenance is needed for the outdoor heat exchange unit 15. This is because the outdoor heat exchange unit 15 is unlikely to be covered with snow. The control unit 19 in this case provides the notification that the maintenance is needed (S616) and then ends the outdoor air-sending operation (S617).

On the other hand, in step S610, when the detected value T of the outdoor air temperature is equal to or lower than the predetermined temperature T1 (S610: Yes), the processing by the control unit 19 proceeds to step S612.

In step S612, the control unit 19 ends the outdoor air-sending operation once.

In step S613, the control unit 19 executes the defrosting operation. In other words, when the current value I during the outdoor air-sending operation is out of the normal range (S608: No) while the detected value T of when this outdoor air-sending operation is started is equal to or lower than the predetermined temperature T1 (S610: Yes), the control unit 19 executes the defrosting operation (S612). Thus, even when the outdoor heat exchange unit 15 is covered with snow, the snow can be melted in this way.

In step S614, the control unit 19 starts the outdoor air-sending operation again.

In step S615, the control unit 19 executes the maintenance necessity determining processing. This maintenance necessity determining processing is processing similar to that in steps S102 to S105 described in First Embodiment (see FIG. 6). In other words, the control unit 19 determines whether the maintenance is needed based on the current value I of the outdoor fan motor 16*b*. In this way, after the defrosting operation (S613), the maintenance necessity determining processing is performed (S615). This can make appropriate determination on whether the maintenance is needed for the outdoor heat exchange unit 15 (e.g., whether the clogging occurs).

In step S616, the control unit 19 provides the notification of whether the maintenance is needed. In other words, the control unit 19 executes the defrosting operation (S613) and then performs the outdoor air-sending operation again (S614), and thereafter if the current value I during this outdoor air-sending operation is still out of the normal range (S103 of FIG. 6 included in S615: No), the control unit 19 provides the notification that the maintenance is needed for the outdoor heat exchange unit 15 (S616).

Then, in step S617, the control unit 19 ends the outdoor air-sending operation.

<Effect>

According to Sixth Embodiment, even when the current value I during the outdoor air-sending operation is out of the normal range (S608: No), the defrosting operation is performed (S613) when the detected value T of the outdoor air is equal to or lower than the predetermined temperature T1 (S610: Yes). This can prevent wrong determination that is "the maintenance is needed for the outdoor heat exchange unit 15" due to the snow covering the outdoor heat exchange unit 15 when no clogging actually occurs in the outdoor heat exchange unit 15.

In addition, performing the maintenance necessity determining processing after the defrosting operation (S613, S616) allows to make appropriate determination on whether the maintenance is needed for the outdoor heat exchange unit 15 and to notify the user and the like of the maintenance necessity (S616).

Seventh Embodiment

Seventh Embodiment is different from Second Embodiment in that the air conditioner 100 (see FIG. 15) transmits the above-described outdoor air temperature and current value I to an air conditioner controlling device 30, and this air conditioner controlling device 30 performs the maintenance necessity determining processing and the like. Other configurations (e.g., the configuration of the air conditioner 100: see FIGS. 1 to 5) are similar to that of Second Embodiment. Thus, the part different from Second Embodiment is described but descriptions of the duplicated parts are omitted.

Figure 15:
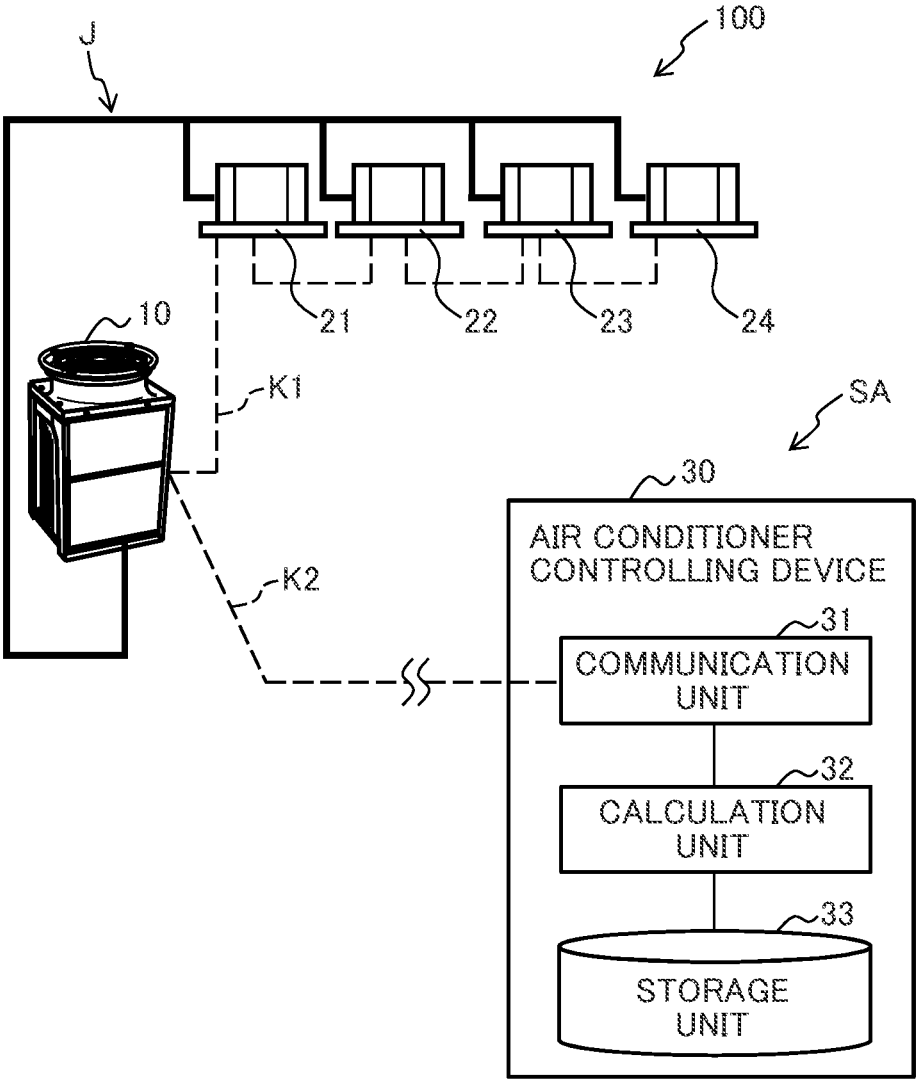
FIG. 15 is a configuration diagram of an air conditioning system according to Seventh Embodiment of the present invention.

FIG. 15 is a configuration diagram of an air conditioning system SA according to Seventh Embodiment.

As shown in FIG. 15, the air conditioning system SA comprises the air conditioner 100 and the air conditioner controlling device 30. The air conditioner 100 comprises the configuration similar to that described in First Embodiment (see FIGS. 1 to 5).

Although one air conditioner 100 is shown in FIG. 15, multiple air conditioners may communicate with the air conditioner controlling device 30.

The air conditioner controlling device 30 is a device that remotely monitors the state of the outdoor unit 10 (that is, performs air conditioning management). As shown in FIG. 15, the air conditioner controlling device 30 comprises a communication unit 31, a calculation unit 32, and a storage unit 33.

The communication unit 31 communicates with the air conditioner 100 via a communication line K2. Data transmitted from the air conditioner 100 to the air conditioner controlling device 30 includes identification information on the air conditioner 100, detected values including the current value I of the outdoor fan motor 16*b*, and date and time when the detected values are detected. Data transmitted from the air conditioner controlling device 30 to the air conditioner 100 includes the identification information on the air conditioner 100 and information on the necessity of the maintenance for the outdoor heat exchange unit 15. The communication between the air conditioner controlling device 30 and the air conditioner 100 may be either wired communication or wireless communication.

The calculation unit 32 is, for example, a microcomputer made of electronic circuits including a CPU, a ROM, a RAM, various interfaces, and the like (not shown). A program stored in the ROM is read and expanded in the RAM, and then the CPU executes various processing. The calculation unit 32 has functions to determine whether the maintenance is needed for the outdoor heat exchange unit 15 based on the current value I received via the communication unit 31 and to notify the user and the like of the determination result.

Not only the program executed by the calculation unit 32 but also the identification information on the air conditioner 100 and the detected values including the current value I of the outdoor fan motor 16*b* are stored in the storage unit 33 with being associated with date and time information.

Figure 16:
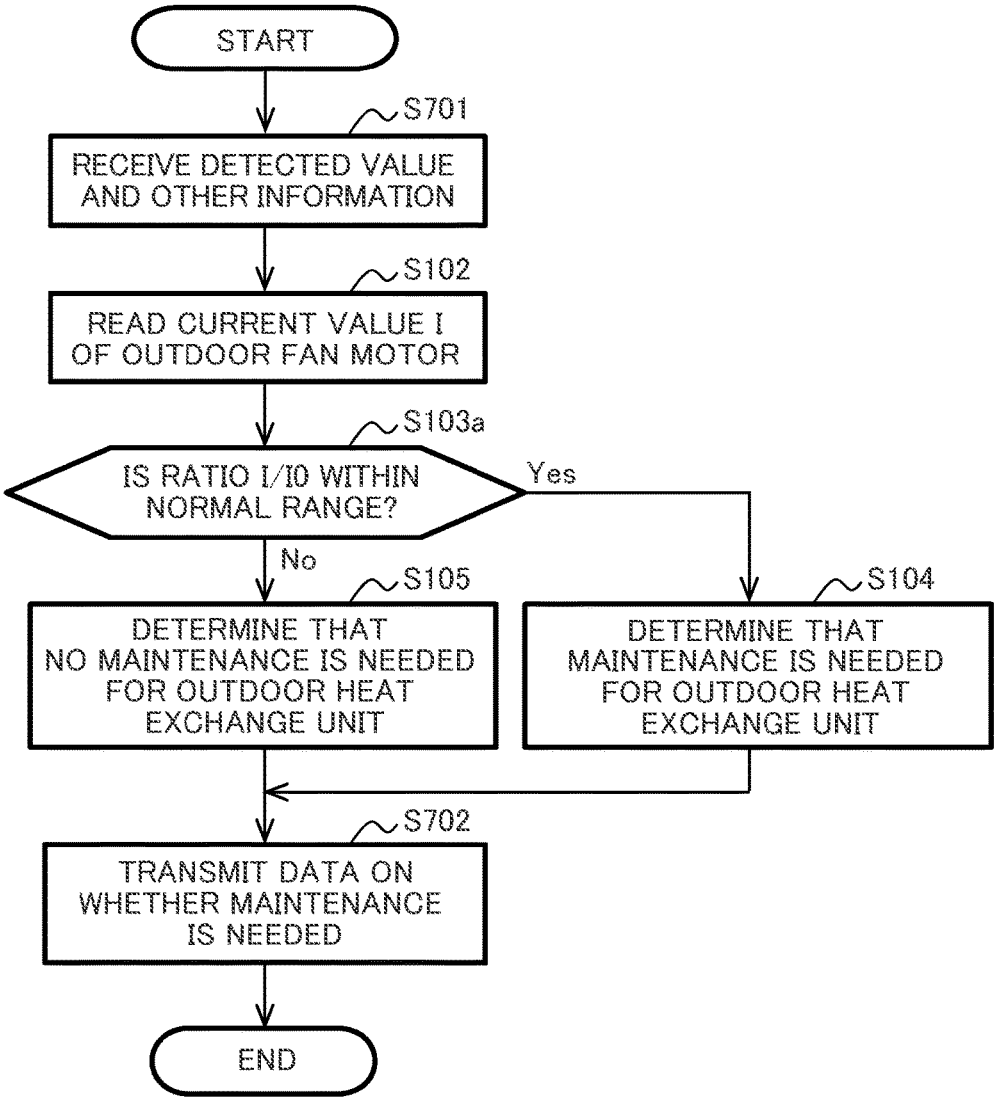
FIG. 16 is a flowchart of processing executed by an air conditioner controlling device of the air conditioning system according to Seventh Embodiment of the present invention.

FIG. 16 is a flowchart of processing executed by the air conditioner controlling device 30 (see FIG. 15 if necessary).

In step S701, the air conditioner controlling device 30 uses the communication unit 31 to receive the detected values and other information on the air conditioner 100. That is, the air conditioner controlling device 30 executes a "communication step" to make communication with the air conditioner 100. The detected values received by the air conditioner controlling device 30 in step S701 includes not only the current value I of the outdoor fan motor 16*b* during the outdoor air-sending operation, but also the information on the date and time when this current value I is detected and the identification information on the air conditioner 100.

Steps S102 to S105 are similar to that of Second Embodiment (see FIG. 9). In other words, the air conditioner controlling device 30 uses the calculation unit 32 to determine whether the maintenance is needed for the outdoor heat exchange unit 15 based on whether the ratio I/I0 is within the predetermined normal range.

In step S702 of FIG. 16, the air conditioner controlling device 30 uses the communication unit 31 to transmit the data on the necessity of the maintenance for the outdoor heat exchange unit 15 to the air conditioner 100 (or a terminal of the user: not shown). That is, the air conditioner controlling device 30 executes a "notification step" to provide the notification of whether the maintenance is needed for the outdoor heat exchange unit 15 based on the airflow resistance during the outdoor air-sending operation.

The air conditioner controlling device 30 may perform well-known "supervised learning" based on temporal changes of the current value I of the outdoor fan motor 16*b* and the actual state such as the state where the clogging occurs in the outdoor heat exchange unit 15 and may set the "normal range" based on the learning result.

<Effect>

According to Seventh Embodiment, because the determination on whether the maintenance is needed for the outdoor heat exchange unit 15 is made by the air conditioner controlling device 30 in this configuration, the processing executed by the control unit 19 of each air conditioner 100 can be simplified. This can save the effort in the phase of creating the program by the control unit 19 and thus the cost of producing the air conditioner 100 can be reduced.

In addition, the data such as the current value I can be stored in the storage unit 33 of the air conditioner controlling device 30, and this data can be used to perform complicated learning processing as a phase prior to the maintenance necessity determining processing.

Moreover, storing, in the storage unit 33, the temporal changes of the data such as the current value I for a long period (e.g., several years) allow being aware of quite a gradual change of the current value I and the like. This data such as the current value I can be used for the maintenance of the air conditioner 100 and the like.

Eighth Embodiment

Eighth Embodiment is different from First Embodiment in that an air conditioner 200 (see FIG. 17) comprises one wall-mounted indoor unit Gi and one outdoor unit Go; however, other configurations (e.g., processing executed by a control unit 60 shown in FIG. 17) are similar to that of First Embodiment. Thus, the part different from First Embodiment is described but descriptions of the duplicated parts are omitted.

Figure 17:
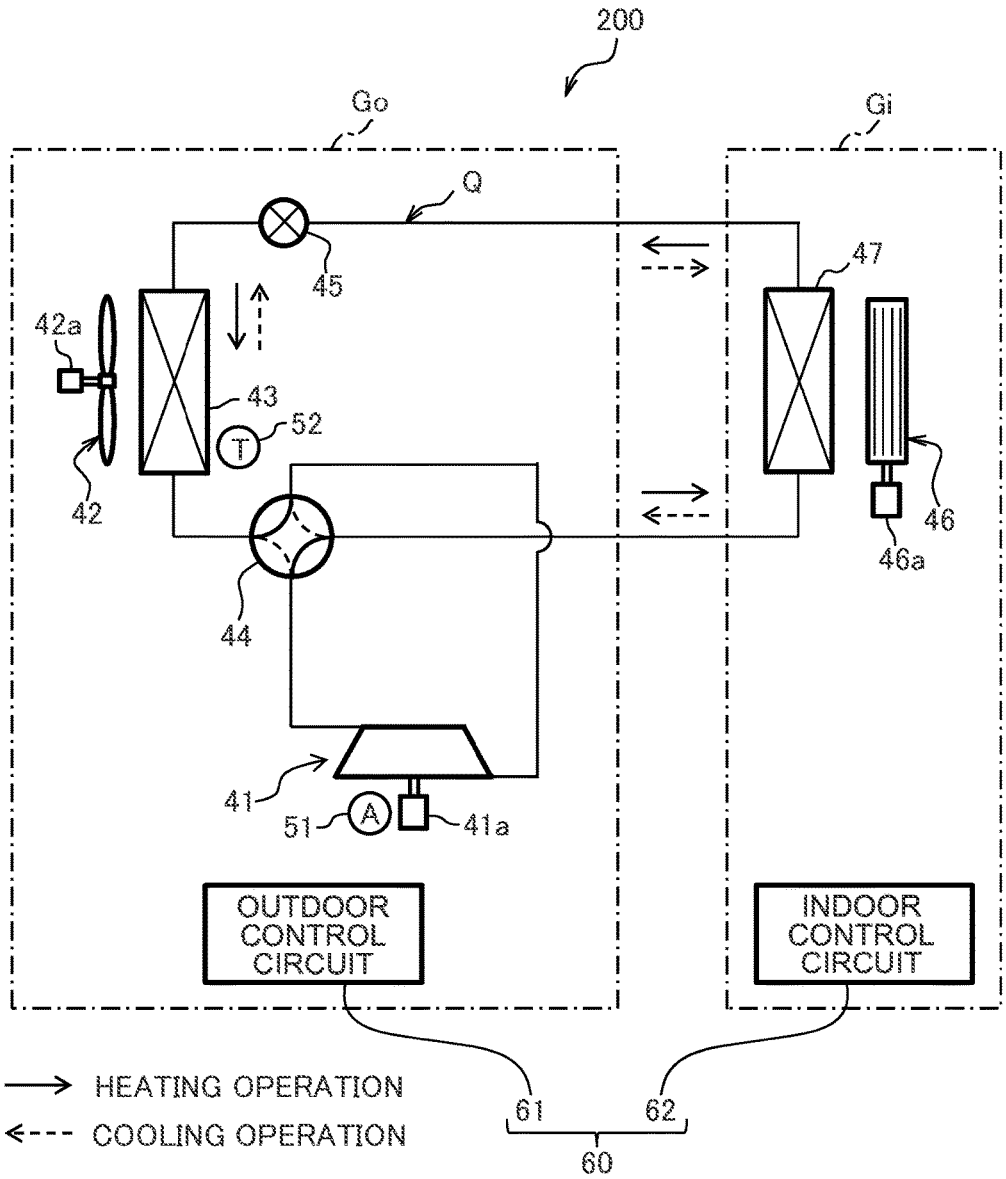
FIG. 17 is a configuration diagram of an air conditioner according to Eighth Embodiment of the present invention.

FIG. 17 is a configuration diagram of the air conditioner 200 according to Eighth Embodiment.

A solid line arrow in FIG. 17 indicates a flowing direction of the refrigerant during the heating operation. A broken line arrow in FIG. 17 indicates a flowing direction of the refrigerant during the cooling operation.

As shown in FIG. 17, the air conditioner 200 comprises a compressor 41, an outdoor fan 42, an outdoor heat exchange unit 43, a four-way valve 44, an expansion valve 45, an indoor fan 46, and an indoor heat exchange unit 47.

In addition to the above configuration, the air conditioner 200 comprises various sensors including a current detector 51 and an outdoor air temperature sensor 52, an outdoor control circuit 61, and an indoor control circuit 62. The refrigerant is circulated through the heat pump cycle in a refrigerant circuit Q made of the compressor 41, the outdoor heat exchange unit 43, the expansion valve 45, and the indoor heat exchange unit 47 which are connected in this order in a circuit form via the four-way valve 44.

The compressor 41 is a device that compresses the gas type refrigerant and comprises a compressor motor 41*a*.

The outdoor fan 42 comprises an outdoor fan motor 42*a* and is installed near the outdoor heat exchange unit 43.

The indoor fan 46 comprises an indoor fan motor 46*a* and is installed near the indoor heat exchange unit 47.

In an example shown in FIG. 17, the outdoor unit Go is installed with the compressor 41, the outdoor fan 42, the outdoor heat exchange unit 43, the four-way valve 44, the expansion valve 45, the current detector 51, the outdoor air temperature sensor 52, and the outdoor control circuit 61. Meanwhile, the indoor unit Gi is installed with the indoor fan 46, the indoor heat exchange unit 47, and the indoor control circuit 62.

A description of processing executed by the "control unit 60" including the outdoor control circuit 61 and the indoor control circuit 62 is omitted because it is similar to the processing executed by the control unit 19 (see FIG. 5) described in First Embodiment (see FIG. 6).

<Effect>

According to Eighth Embodiment, in the wall-mounted air conditioner 200 comprising one outdoor unit Go and one indoor unit Gi, the notification of whether the maintenance is needed for the outdoor heat exchange unit 43 can be provided in appropriate timing.

«Modification»

The air conditioners 100, 200 and the air conditioning system SA according to the present invention are described above with reference to the embodiments; however, the present invention is not limited to these descriptions and can be modified in various ways.

For example, although the embodiments describe the example in which the determination on whether the maintenance is needed for the outdoor heat exchange unit 15 is made based on the current value I of the outdoor fan motor 16*b*, it is not limited thereto. In other words, the control unit 19 may make the determination on whether the maintenance is needed for the outdoor heat exchange unit 15 based on an electric power value of the outdoor fan motor 16*b*. This is because a voltage applied to the outdoor fan motor 16*b* is usually substantially constant, and thus the current value (an effective value) and the electric power value have a proportional relationship.

In addition, for example, the control unit 19 may estimate a value of the airflow resistance of the outdoor heat exchange unit 15 based on the current value I of the outdoor fan motor 16*b* and features of the airflow volume, the pressure, and the shaft power of the outdoor fan motor 16*b*. When the value of the above airflow resistance is out of the predetermined normal region, the control unit 19 may provide the notification that the maintenance is needed for the outdoor heat exchange unit 15.

Moreover, for example, the pressure sensor (not shown) may be installed in a predetermined part of the outdoor unit 10, and the airflow resistance of the outdoor heat exchange unit 15 may be calculated based on a detected value of this pressure sensor.

Although the example in which the main control circuit 19*a* (see FIG. 5), the compressor controller 19*b*, and the fan controller 19*c* are implemented on different boards respectively is described in First Embodiment, it is not limited thereto. In other words, multiple ones out of the main control circuit 19*a*, the compressor controller 19*b*, and the fan controller 19*c* may be implemented on one board.

Although the processing for detecting the outdoor air temperature of when starting the heating operation (S602 of FIG. 13) is described in Sixth Embodiment, it is not limited thereto. For example, the control unit 19 may read the outdoor air temperature at predetermined timing between the start of the heating operation and the determination on whether the maintenance is needed for the outdoor heat exchange unit 15.

Although the configuration in which one indoor unit Gi and one outdoor unit Go are provided is described in Eighth Embodiment, it is not limited thereto. In other words, multiple indoor units Gi connected in parallel may be provided, and multiple outdoor units Go connected in parallel may be provided.

The embodiments can be combined if necessary. For example, the control unit 19 may execute the following processing by combining Fourth Embodiment (see FIG. 11) and Fifth Embodiment (see FIG. 12). In other words, the control unit 19 may execute the defrosting operation to defrost the outdoor heat exchange unit 15 after performing the heating operation as the air conditioning operation, and then may provide the notification of whether the maintenance is needed for the outdoor heat exchange unit 15 based on the airflow resistance during the subsequent outdoor air-sending operation. This can prevent wrong determination that is "the clogging occurs" due to the frost attached on the outdoor heat exchange unit 15 when no clogging actually occurs in the outdoor heat exchange unit 15.

For example, the control unit 19 may execute the following processing by combining Fourth Embodiment (see FIG. 11) and Sixth Embodiment (see FIGS. 13 and 14). In other words, the control unit 19 may perform the outdoor air-sending operation before starting the heating operation, and when the current value I during the outdoor air-sending operation is out of the normal region, the control unit 19 may determine whether the detected value T of the outdoor air temperature is equal to or lower than the predetermined temperature T1. In this case, when the detected value T of the outdoor air temperature is equal to or lower than the predetermined temperature T1, the control unit 19 executes the maintenance necessity determining processing after performing the defrosting operation.

In addition, for example, Seventh Embodiment in which the air conditioner controlling device 30 determines whether the maintenance is needed for the outdoor heat exchange unit 15 can be combined with any one of First and Third to Sixth Embodiments.

The embodiments are described in details so as to clearly describe the present invention, and the present invention is not necessarily limited to those including all the configurations described above. A part of the configuration of each embodiment may be altered by addition, deletion, or replacement with another configuration.

The mechanisms and configurations described above are only those thought to be necessary for the explanation, and the foregoing description is not necessarily provided for all the mechanisms and configurations constituting the product.

REFERENCE SIGNS LIST

100, 200: air conditioner
10: outdoor unit
11: casing
12: compressor
13: accumulator

14: electrical component box
15: outdoor heat exchange unit
16: outdoor fan
16*a*: fan main body
16*b*: outdoor fan motor
17: current detector
18: outdoor air temperature sensor
19: control unit
21, 22, 23, 24: indoor unit
30: air conditioner controlling device
31: communication unit
32: calculation unit
33: storage unit
41: compressor
42: outdoor fan
42*a*: outdoor fan motor
43: outdoor heat exchange unit
44: four-way valve
45: expansion valve
46: indoor fan
46*a*: indoor fan motor
47: indoor heat exchange unit
51: current detector
52: outdoor air temperature sensor
60: control unit
J, Q: refrigerant circuit
SA: air conditioning system

The invention claimed is:

1. An outdoor unit for an air conditioner, comprising:
a compressor;
an outdoor heat exchange unit through which a refrigerant flows by driving of the compressor;
an outdoor fan that includes an outdoor fan motor and is installed near the outdoor heat exchange unit; and
a control unit connected to the compressor and the outdoor fan motor,
wherein the control unit is configured to:
upon receiving an instruction to start an air conditioning operation, start a defrosting operation that drives the compressor to defrost the outdoor heat exchange unit, and after completing the defrosting operation, provide notification of whether maintenance is needed for the outdoor heat exchange unit based on an airflow resistance during an outdoor air-sending operation in which the outdoor fan is driven to send outdoor air into the outdoor heat exchange unit while the compressor is stopped.

2. The outdoor unit according to claim 1, wherein
the control unit is configured to: use a value of a current or electric power of the outdoor fan motor as a value reflecting the airflow resistance, and
when the value during the outdoor air-sending operation is out of a predetermined normal range, provide the notification that the maintenance is needed for the outdoor heat exchange unit.

3. The outdoor unit according to claim 2, wherein
the control unit is configured to:
upon determining an outdoor air temperature is equal to or lower than a predetermined temperature when the value during the outdoor air-sending operation is out of the normal range, execute the defrosting operation to defrost the outdoor heat exchange unit and then perform the outdoor air-sending operation again, and thereafter if the value during the outdoor air-sending operation is still out of the normal range, the control unit provide the notification that the maintenance is needed for the outdoor heat exchange unit.

4. The outdoor unit according to claim 1, wherein
the control unit is configured to provide the notification of whether the maintenance is needed for the outdoor heat exchange unit based on a ratio of a value of a current or electric power of the outdoor fan motor during the current outdoor air-sending operation to the value during the outdoor air-sending operation under the condition where the outdoor heat exchange unit is confirmed as normally operating.

5. The outdoor unit according to claim 1, wherein
the control unit is configured to perform the outdoor air-sending operation before the air conditioning operation and provide the notification of whether the maintenance is needed for the outdoor heat exchange unit based on the airflow resistance during the outdoor air-sending operation.

6. The outdoor unit according to claim 1, wherein
the control unit is configured to: perform the outdoor air-sending operation after stopping an air conditioning operation by driving the outdoor fan motor, and provide the notification of whether the maintenance is needed for the outdoor heat exchange unit based on the airflow resistance during the outdoor air-sending operation.

7. The outdoor unit according to claim 6, wherein
the control unit is configured to: execute the defrosting operation to defrost the outdoor heat exchange unit after performing a heating operation as the air conditioning operation, and then provide the notification of whether the maintenance is needed for the outdoor heat exchange unit based on the airflow resistance during the subsequent outdoor air-sending operation.

8. An air conditioner, comprising:
a refrigerant circuit including a compressor, an outdoor heat exchange unit, an expansion valve, and an indoor heat exchange unit which are connected in this order in a circuit form via a four-way valve;
an outdoor fan that includes an outdoor fan motor and is installed near the outdoor heat exchange unit;
an indoor fan that includes an indoor fan motor and is installed near the indoor heat exchange unit; and
a control unit that controls the compressor, the expansion valve, the four-way valve, the outdoor fan, and the indoor fan,
wherein the control unit is configured to:
upon receiving an instruction to start an air conditioning operation, start a defrosting operation that drives the compressor to defrost the outdoor heat exchange unit, and after completing the defrosting operation, provide notification of whether maintenance is needed for the outdoor heat exchange unit based on an airflow resistance during an outdoor air-sending operation in which the outdoor fan is driven to send outdoor air into the outdoor heat exchange unit while the compressor is stopped.

9. A method for controlling an air conditioner, comprising:
a communication step of causing an air conditioner controlling device to communicate with an air conditioner that includes a compressor, an outdoor heat exchange unit through which a refrigerant flows by driving of the compressor, an outdoor fan that includes an outdoor fan motor and is installed near the outdoor heat exchange unit, and a control unit that controls at least the compressor and the outdoor fan;
a step of receiving, by the control unit, an instruction to start an air conditioning operation by the control unit, start a defrosting operation that drives the compressor to defrost the outdoor heat exchange unit, and after completing the defrosting operation; and a notification step of causing the air conditioner controlling device to provide notification of whether maintenance is needed for the outdoor heat exchange unit based on an airflow resistance during an outdoor air-sending operation in which the outdoor fan is driven to send outdoor air into the outdoor heat exchange unit while the compressor is stopped.

* * * * *